US010669847B2

(12) United States Patent
Smarandache et al.

(10) Patent No.: US 10,669,847 B2
(45) Date of Patent: Jun. 2, 2020

(54) DOUBLE ROD LOCK SYSTEM

(71) Applicant: Schlumberger Technology Corporation, Sugar Land, TX (US)

(72) Inventors: Marius Smarandache, Houston, TX (US); Sebastien Ives, Houston, TX (US); Douglas Grant, College Station, TX (US); Lorena Lopez Pinana, Houston, TX (US); Akhil Bahl, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 544 days.

(21) Appl. No.: 15/371,710

(22) Filed: Dec. 7, 2016

(65) Prior Publication Data

US 2017/0175525 A1 Jun. 22, 2017

Related U.S. Application Data

(60) Provisional application No. 62/269,083, filed on Dec. 17, 2015.

(51) Int. Cl.
*E21B 49/08* (2006.01)

(52) U.S. Cl.
CPC ..... *E21B 49/082* (2013.01)

(58) Field of Classification Search
CPC ..... E21B 49/081; E21B 49/082
See application file for complete search history.

(56) References Cited

U.S. PATENT DOCUMENTS 2,741,313 A * 4/1956 Bagnell ..... E21B 33/127 166/147
3,291,219 A * 12/1966 Nutter ..... E21B 33/1243 166/145
3,447,606 A * 6/1969 Scott ..... E21B 43/10 166/147
3,504,750 A * 4/1970 Rouviere ..... E21B 25/00 175/244

(Continued)

FOREIGN PATENT DOCUMENTS

CN 202467833 10/2012
WO WO9601064 A1 1/1996

OTHER PUBLICATIONS

Combined Search and Examination Report issued in the related GB Application 1620972.8, dated May 15, 2017 (6 pages).

(Continued)

*Primary Examiner* — Shane Bomar
(74) *Attorney, Agent, or Firm* — Cameron R. Sneddon

(57) ABSTRACT

A technique facilitates obtaining samples of well fluid or other fluid. A sampling tool comprises a sample chamber for collecting the fluid sample. Access to the sample chamber is controlled with a rod shiftable within the sampling tool. Additionally, a locking mechanism works in cooperation with the rod to lock the rod against undesirable movement at various stages of the sampling operation. The locking mechanism may comprise a pair of locking features which engage a groove in the rod to initially block inadvertent closure of access to the sample chamber and subsequently to block inadvertent opening of access to the sample chamber after collection of the fluid sample.

20 Claims, 4 Drawing Sheets

(56) References Cited

U.S. PATENT DOCUMENTS

| | | | | | |
|---|---|---|---|---|---|
| 4,050,315 | A | * | 9/1977 | Markfelt | E21B 49/082 73/864.66 |
| 4,372,382 | A | * | 2/1983 | Rooney | E21B 49/081 166/165 |
| 4,502,571 | A | | 3/1985 | FGeppert | |
| 4,871,019 | A | * | 10/1989 | Haley | E21B 34/14 166/167 |
| 6,467,544 | B1 | | 10/2002 | Brown et al. | |
| 9,316,519 | B2 | | 4/2016 | Parker et al. | |

OTHER PUBLICATIONS

Examination Report issued in the related GB Application 1620972.8, dated Jun. 21, 2019 (3 pages).

* cited by examiner

DOUBLE ROD LOCK SYSTEM

BACKGROUND

In many types of well applications, fluid samples are obtained and tested to help evaluate well fluid and/or geologic formation parameters. Some sampling operations may be performed during other well related operations, such as drilling operations. To obtain the desired fluid sample or samples, a sampling tool is deployed downhole into a wellbore and the fluid sample is drawn into the tool through a sampling port. A variety of pistons and/or other devices may be used in the sampling tool to intake the fluid sample into a sample chamber. However, problems can sometimes occur due to inadvertent closing and/or opening of the sample chamber with respect to the sampling port.

SUMMARY

In general, a system and methodology are provided for obtaining a fluid sample. By way of example, the system and methodology may be used in a wellbore for obtaining samples of well fluid. According to an embodiment, a sampling tool comprises a sample chamber for collecting the fluid sample from fluid located externally of the sampling tool. Access to the sample chamber is controlled with a rod shiftable within the sampling tool. Additionally, a locking mechanism works in cooperation with the rod to lock the rod against undesirable movement at different stages of the sampling operation. For example, the locking mechanism may comprise a pair of locking features which engage a groove in the rod to initially block inadvertent closure of access to the sample chamber and subsequently to block inadvertent opening of access to the sample chamber after collection of the fluid sample.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
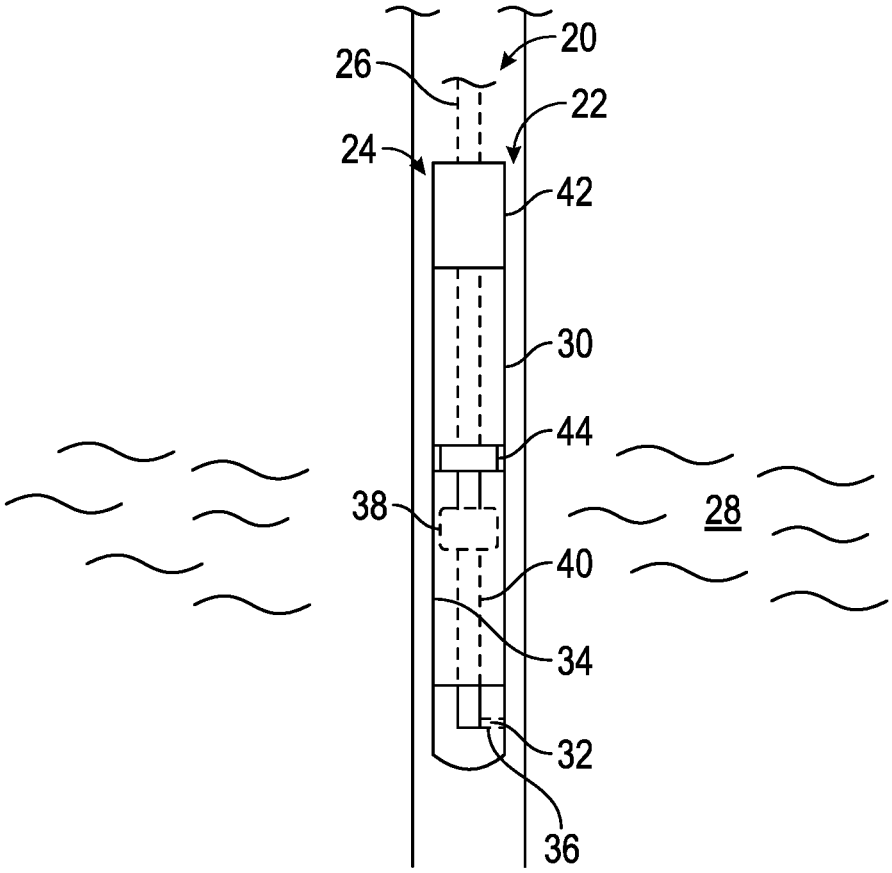
FIG. 1 is a schematic illustration of an example of a sampling system deployed in a wellbore to collect a fluid sample, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which may be used to obtain fluid samples in a variety of environments, such as wellbore environments. According to a wellbore related embodiment, the system utilizes at least one sampling tool which may be delivered downhole on a suitable conveyance for sampling wellbore fluids flowing into the wellbore from a surrounding formation. The sampling system may utilize a sampling tool having a sample chamber for collecting a fluid sample from fluid located externally of the sampling tool, e.g. well fluid in the wellbore.

Access to the sample chamber is controlled with a rod shiftable within the sampling tool. For example, the rod may comprise a seal, e.g. a plurality of seals, which may be selectively moved into and out of sealing engagement with a surrounding wall surface to block or allow flow of fluid through a sampling port. Additionally, a locking mechanism works in cooperation with the rod to lock the rod against undesirable movement at various stages of the sampling operation. For example, the locking mechanism may comprise a pair of locking features which engage a groove in the rod to initially block inadvertent closure of access to the sample chamber and subsequently to block inadvertent opening of access to the sample chamber after collection of the fluid sample. By blocking inadvertent opening of the sample chamber, the collected fluid sample is protected from release back out through the sampling port.

In a specific embodiment, the locking mechanism comprises a double rod lock mechanism through which the rod extends. The rod locking mechanism cooperates with the rod to enable selective locking of the rod in at least two different phases. For example, the rod locking mechanism may comprise a front lock and a rear lock for preventing undesired axial movement of the rod at specific stages of the sampling operation. The front lock may be used to prevent the sampling tool from prematurely closing during a sampling phase. In this example, the rear lock may be used to maintain the sampling tool locked shut after the sampling phase to prevent unintentional opening of the sample chamber, e.g. sample bottle, which could lead to loss of fluid sample. The ability to lock the rod at different phases of the sampling operation protects the sampling tool from premature closing and/or opening of the sample chamber, thus providing a more reliable sampling system and methodology.

Although the rod locking mechanism may comprise various locking features, one embodiment uses a first locking feature, e.g. a front locking feature, and a second locking feature, e.g. a rear locking feature, which cooperate with a groove formed in the rod. The first locking feature comprises a first loose element which may be in the form of a first set of ball bearings. Similarly, the second locking feature comprises a second loose element which may be in the form of a second set of ball bearings axially spaced along the rod from the first set of ball bearings. In this example, the first and second sets of ball bearings cooperate with first and second collars, respectively, to hold the ball bearings at a desired radially inward position within the groove or against a radially outer surface of the rod.

The construction and arrangement of the first and second locking features also minimize loss of sample volume while also helping increase shock resistance. In at least some embodiments, the rod lock mechanism may be constructed to allow sufficient forward movement of the rod so that a pressure balance may be maintained within the sampling tool between the front and rear ends of the rod.

Referring generally to FIG. 1, an embodiment of a sampling system 20 deployed in a wellbore 22 is illustrated. In this example, the sampling system 20 comprises a sampling tool 24 which may be deployed downhole into wellbore 22 via a suitable conveyance 26, e.g. wireline or coiled tubing. The wellbore 22 extends into a geologic formation 28 carrying fluids which may flow into wellbore 22 along an exterior of sampling tool 24. Fluid samples may be obtained from this external fluid by sampling tool 24 for analysis.

The sampling tool 24 may be constructed in a variety of configurations for use in many types of sampling applications. In some applications, the sampling tool 24 may be constructed to collect an individual fluid sample and other embodiments of sampling tool 24 may be used to collect multiple fluid samples. An example of a suitable type of sampling tool 24 is the single-phase multi-sample chamber sampling tool available from Schlumberger Corporation. By way of example, the sampling tool 24 may comprise a housing 30 having at least one sampling port 32 through which a fluid sample or samples may be received from fluids located in wellbore 22 externally of sampling tool 24. The sampling port 32 may selectively be placed in communication with a sample chamber 34, e.g. a sample bottle, via a flow passage 36.

In at least some embodiments, a piston 38 is slidably disposed within housing 30 in cooperation with sample chamber 34. The piston 38 may be shifted axially along sample chamber 34 to enable a fluid sample to flow in through sampling port 32 and into sample chamber 34. Shifting of piston 38 may be achieved by an actuator or by pressure differentials established at the downhole sampling location as with conventional sampling tools. In some applications, the sample chamber 34 may be charged initially with a desired fluid, e.g. nitrogen gas, to facilitate collection of the desired fluid sample.

According to the embodiment illustrated, fluid access to sample chamber 34 via sampling port 32 is controlled by a rod 40 which may be shifted by, for example, an actuator 42. The rod 40 is selectively shifted between a position allowing fluid flow between sampling port 32 and sample chamber 34 and a position blocking fluid flow between sampling port 32 and sample chamber 34. The actuator 42 may comprise a variety of suitable actuators, including hydraulic actuators, electrical actuators, or other suitable actuators for shifting rod 40 axially between flow positions. As illustrated, the rod 40 may extend through piston 38 such that piston 38 moves along rod 40 and along an interior of housing 30.

The rod 40 may be selectively locked against certain axial movements by a rod lock mechanism 44 positioned for engagement with rod 40 within housing 30. By way of example, the rod lock mechanism 44 may comprise a plurality of locking features to prevent premature movement of the rod 40 to a closed flow position during sampling and also to prevent movement of the rod 40 to an open flow position after collection of the fluid sample in sample chamber 34. An embodiment of rod lock mechanism 44 is discussed in greater detail herein with reference to FIGS. 2-5.

Figure 2:
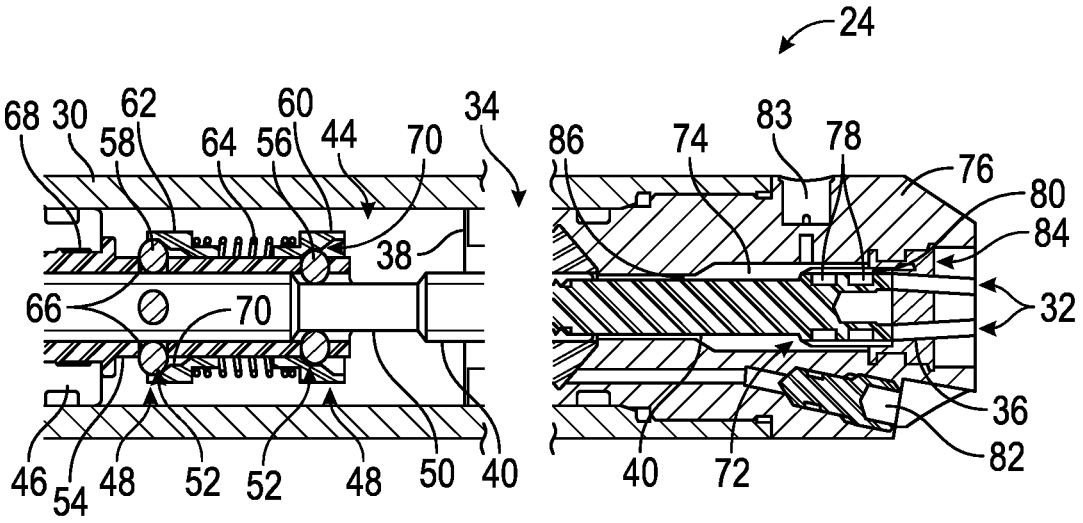
FIG. 2 is a cross-sectional view of a portion of an embodiment of the sampling tool illustrated in FIG. 1, according to an embodiment of the disclosure.

Referring initially to FIG. 2, an embodiment of rod lock mechanism 44 is illustrated as disposed within housing 30 of sampling tool 24. The rod lock mechanism 44 is positioned along rod 40 for engagement with rod 40 and may be mounted along the interior of housing 30 via a mounting structure 46. In this example, the rod lock mechanism 44 comprises locking features 48 which interact with a groove 50 formed in rod 40 to selectively block axial shifting of rod 40 at desired stages of the fluid sampling operation.

By way of example, each locking feature 48 may comprise at least one loose element 52 movably held by a cage 54 (or other suitable structure) for radial movement in cooperation with rod 40 and groove 50. In some embodiments, the locking features 48 may comprise a first, e.g. front, set of ball bearings 56 and a second, e.g. rear, set of ball bearings 58. The loose element/first set of ball bearings 56 and the loose element/second set of ball bearings 58 are axially spaced from each other and may be held at an axial distance from each other greater than the axial length of groove 50.

In this embodiment, the first set of ball bearings 56 and the second set of ball bearings 58 are held radially inward against rod 40 by first collar 60 and second collar 62, respectively. The first collar 60 and the second collar 62 may be biased in an axial direction away from each other by a spring member 64, e.g. a coil spring positioned around cage 54. When the loose elements 52 are in the form of ball bearings 56, 58, cage 54 may be structured as a ball cage having openings 66 which receive ball bearings 56, 58 and allow radial movement of ball bearings 56, 58. The ball cage 54 may be secured to mounting structure 46 by, for example, a threaded engagement region 68.

FIG. 2 illustrates sampling tool 24 in a pre-sampling configuration in which the first set of ball bearings 56 is held at a radially inward position within groove 50 by first collar 60. The second set of ball bearings 58 is biased inwardly in a radial direction by second collar 62 but rests against the larger external diameter of rod 40. It should be noted that first collar 60 and second collar 62 may comprise internal surfaces 70, e.g. sloped or stepped surfaces, able to hold ball bearings 56, 58 radially inward against rod 40 at groove 50 or at the larger diameter external surface of rod 40.

At this stage, a distal end 72 of rod 40 is positioned within an expanded cavity 74 of housing 30. The expanded cavity 74 may be located within a head portion 76 of housing 30 which also may include the port or ports 32. The distal end 72 of rod 40 may comprise a seal 78, e.g. a plurality of seals, and a sleeve 80. The axial lengths of groove 50 and of expanded cavity 74 enable sufficient forward movement of rod 40 to maintain a pressure balance between axial ends of rod 40. Depending on the application, sampling tool 24 also may comprise various other and/or additional features, such as a fill port 82, a port 83 for setting the position of rod 40 at the surface (subsequently plugged), and sensors 84.

Figure 3:
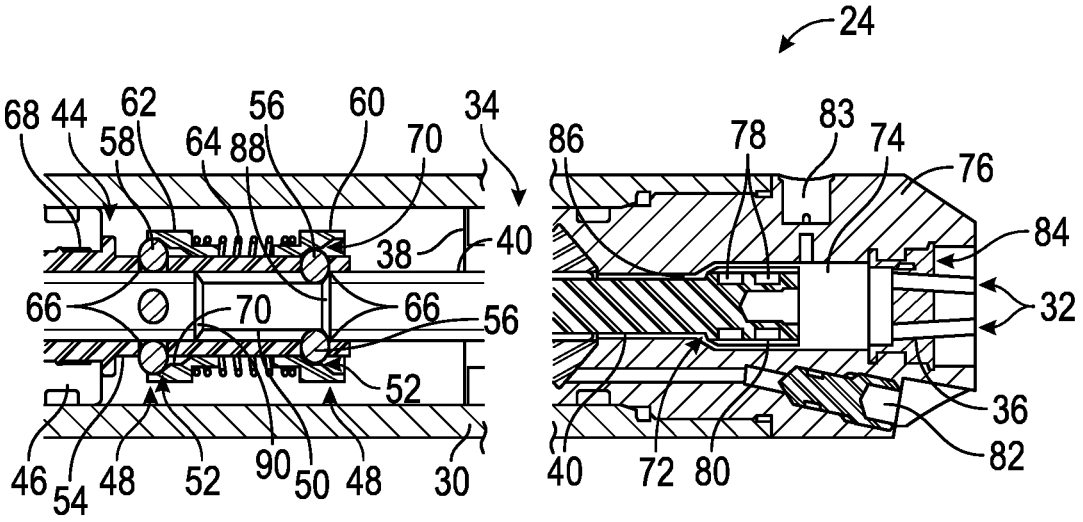
FIG. 3 is a cross-sectional view similar to that of FIG. 2 but showing the sampling tool in a different operational position, according to an embodiment of the disclosure.

During a subsequent sampling phase, rod 40 is shifted by actuator 42 (see FIG. 1) to a new position as illustrated in FIG. 3. This allows a fluid sample to be drawn into the sampling tool 24 through port 32 and to progress along flow passage 36 into sample chamber 34 as piston 38 is shifted along the interior of housing 30. At this stage, the rod lock mechanism 44 prevents premature closure with respect to flow from port 32 to sample chamber 34 by blocking axial movement of rod 40 which would allow seals 78 to move into sealing engagement with internal seal surface 86 of head portion 76. Specifically, the first set of ball bearings 56 is held in groove 50 and abuts against a first abutment end 88 defining an axial end of groove 50. Consequently, premature closure of the sample flow path to sample chamber 34, e.g. premature closure due to shock or friction and pressure, is prevented as the sample piston 38 travels along the sample chamber 34 within housing 30. First abutment end 88 is on opposite axial end of groove 50 from a second abutment end 90.

Figure 4:
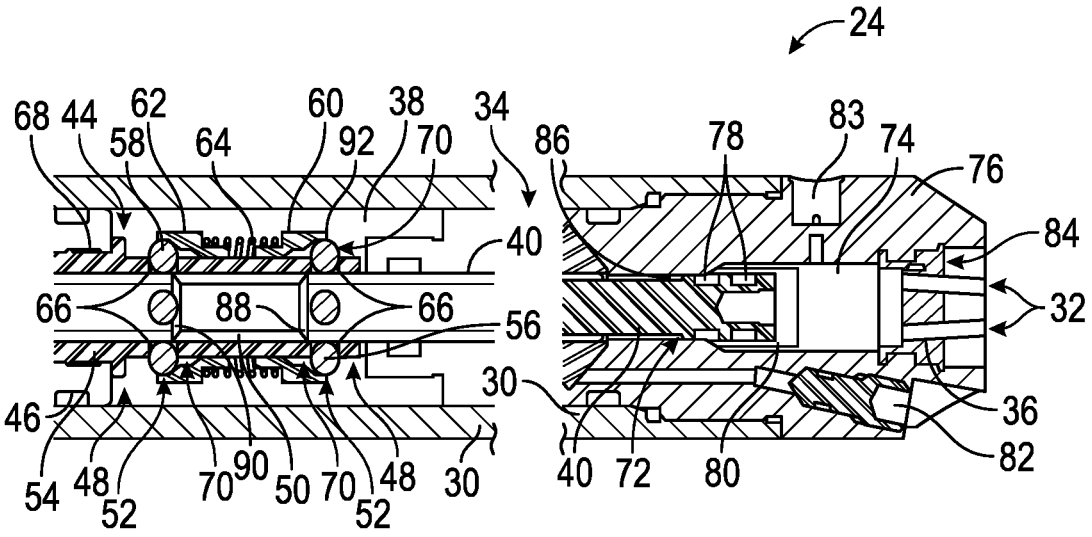
FIG. 4 is a cross-sectional view similar to that of FIG. 2 but showing the sampling tool in a different operational position, according to an embodiment of the disclosure.

At the end of the sampling phase, sampling piston 38 moves into cooperation with rod lock mechanism 44 until an engagement feature 92 of piston 38 contacts the first collar 60, as illustrated in FIG. 4. The movement of engagement feature 92 against first collar 60 forces the first collar 60 in an axial direction against spring member 64 until the loose element 52, e.g the first set of ball bearings 56, is released from groove 50. Once the first set of ball bearings 56 is released from groove 50, the rod 40 may be moved by actuator 42 towards the rear end of sampling tool 24. The first set of ball bearings 56 simply move along the larger diameter external surface of rod 40, as illustrated in FIG. 4. Simultaneously, the seals 78 are pulled from sleeve 80 and moved into sealing engagement with internal seal surface 86. Once the seals 78 are in sealing engagement with internal seal surface 86, further flow of fluid between sampling port 32 and sample chamber 34 is blocked.

Figure 5:
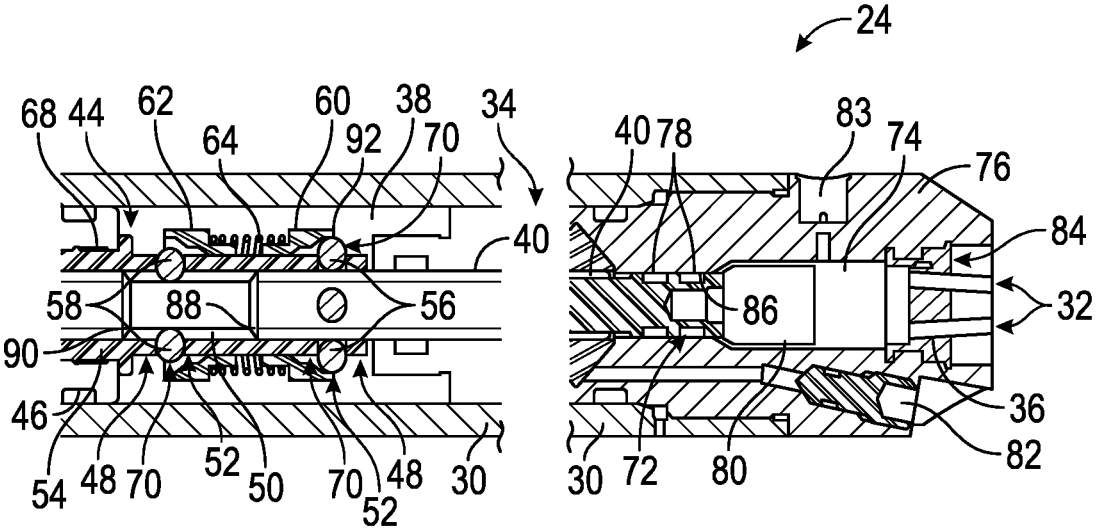
FIG. 5 is a cross-sectional view similar to that of FIG. 2 but showing the sampling tool in a different operational position, according to an embodiment of the disclosure.
Figure 6:
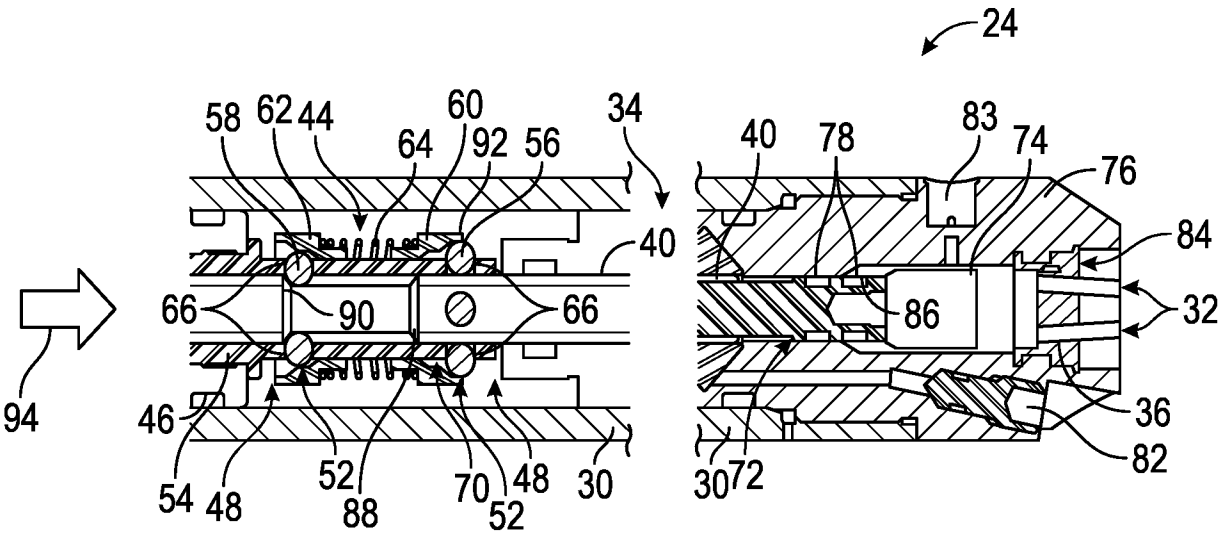
FIG. 6 is a cross-sectional view similar to that of FIG. 2 but showing the sampling tool in a different operational position, according to an embodiment of the disclosure.

To prevent premature opening of the flow path between sample chamber 34 and sampling port 32, the rod 40 is moved axially a sufficient distance to allow the corresponding loose element 52, e.g. the second set of ball bearings 58, to move into groove 50, as illustrated in FIG. 5. The second set of ball bearings 58 is held in groove 50 by second collar 62. For example, the spring loading of second collar 62 in an axial direction via spring member 64 in combination with the sloped, e.g. stepped, profile of the corresponding internal surface 70 ensures that ball bearings 58 are held radially inward within groove 50. Referring to FIG. 6, continued axial movement of rod 40 in the direction of arrow 94 to an open flow position is restricted by abutment of the second set of ball bearings 58 against the second abutment end 90 defining an axial end of groove 50 opposite abutment end 88. Consequently, premature opening of the sample flow path between sample chamber 34 and sampling port 32 is prevented.

Depending on the application, the sampling system 20 may have a variety of configurations and/or components. For example, various configurations of individual or plural sampling pistons 38 may be utilized to facilitate collection and containment of the desired fluid sample(s). Similarly, the configuration of rod 40 and rod actuator 42 may vary and may be selected according to the parameters of a given sampling operation and environment. The rod lock mechanism 44 also may have various configurations and may be positioned at different locations along the sampling tool 24 depending on the structure and usage of the sampling tool. For example, the rod lock mechanism 44 may utilize different types of loose elements, e.g. ball bearings, rollers, pins, and/or other suitable elements able to undergo the desired radial movement. Similarly, various types of collars and spring members may be used in cooperation with the loose elements. The flow path between sampling port 32 and sample chamber 34 may be routed along rod 40 and/or through other flow passages routed along the sampling tool.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for obtaining a fluid sample in a wellbore, comprising:

a sampling tool, comprising:

a housing having a sampling port and a sample chamber;

a piston positioned in the housing to draw a fluid sample into the sample chamber;

a rod extending through the piston, wherein the piston is movable along the rod, the rod having a seal, the rod being shiftable to move the rod and the seal from an open flow position allowing flow of the fluid sample through the sampling port to a closed flow position blocking flow through the sampling port; and a rod lock mechanism coupled with the rod, the rod lock mechanism comprising a plurality of locking features to prevent premature movement of the rod to the closed flow position and to prevent movement of the rod to the open flow position after collection of the fluid sample.

2. The system as recited in claim 1, wherein the rod lock mechanism comprises a first set of ball bearings and a second set of ball bearings axially spaced from the first set of ball bearings, the first set of ball bearings and the second set of ball bearings cooperating with a groove formed in the rod to prevent undesired movement of the rod.

3. The system as recited in claim 2, wherein the rod lock mechanism further comprises a first collar for selectively holding the first set of ball bearings in the groove.

4. The system as recited in claim 3, wherein the rod lock mechanism further comprises a second collar for selectively holding the second set of ball bearings in the groove.

5. The system as recited in claim 4, where the first collar and the second collar are both biased by a spring to positions holding the first set of ball bearings and the second set of ball bearings radially inwardly against the rod.

6. The system as recited in claim 5, wherein the first collar is shiftable by the piston to release the first set of ball bearings from the groove.

7. The system as recited in claim 6, wherein release of the first set of ball bearings from the groove enables further axial shifting of the rod until the second set of ball bearings is moved into the groove.

8. The system as recited in claim 7, wherein the second collar secures the second set of ball bearings in the groove in a manner which prevents shifting of the rod to the open flow position.

9. The system as recited in claim 1, wherein the rod is pressure balanced within the housing.

10. A method, comprising:

providing a sampling tool with a sample chamber for collecting a fluid sample from fluid located externally of the sampling tool;

controlling access to the sample chamber with a rod shiftable within the sampling tool; and using a locking mechanism with a pair of separate locking features to selectively engage a groove in the rod to initially block inadvertent closure of access to the sample chamber and selectively engage the grove in the rod to subsequently block inadvertent opening of access to the sample chamber after collection of the fluid sample.

11. The method as recited in claim 10, wherein using the locking mechanism comprises using the pair of locking features in the form of a first set of ball bearings and a second set of ball bearings spaced axially from the first set of ball bearings.

12. The method as recited in claim 11, wherein using the locking mechanism comprises securing the first set of ball bearings in the groove initially to block inadvertent closure.

13. The method as recited in claim 12, wherein using comprises releasing the first set of ball bearings from the groove and securing the second set of ball bearings in the groove to subsequently block inadvertent opening.

14. The method as recited in claim 13, further comprising securing the first set of ball bearings and the second set of ball bearings with a ball cage through which the rod slidably extends.

15. The method as recited in claim 14, further comprising controlling a radial positioning of the first set of ball bearings and the second set of ball bearings with a first collar and a second collar, respectively.

16. The method as recited in claim 15, further comprising using a piston positioned in cooperation with the sample chamber to facilitate movement of the fluid sample into the sample chamber; and further using the piston to act against the first collar to selectively release the first set of balls from the groove.

17. The method as recited in claim 10, further comprising providing space to allow sufficient axial movement of the rod to pressure balance the rod between axial ends of the rod.

18. A system, comprising:

a locking mechanism to control movement of a rod through the locking mechanism, the locking mechanism comprising:

a first loose element movably held in a cage at a first axial position;

a second loose element movably held in the cage at a second axial position axially spaced from the first axial position;

a first collar positionable to selectively secure the first loose element at a radially inward position within a groove formed in the rod or at a radially outward position against the rod; and a second collar positionable to selectively secure the second loose element at a radially inward position within the groove or at a radially outward position against the rod, the first loose element and the second loose element being held in the groove or released from the groove to selectively lock the rod against a plurality of specific axial movements.

19. The system as recited in claim 18, further comprising a housing having a sample chamber, wherein the rod further comprises a seal which is movable to close or open access to the sample chamber.

20. The system as recited in claim 18, wherein the groove has an axial length which does not allow the first loose element and the second loose element into the groove simultaneously.

* * * * *